US005153606A

United States Patent [19]

Bas

[11] Patent Number: 5,153,606

[45] Date of Patent: Oct. 6, 1992

[54] WIDE THERMAL PRINTER

[75] Inventor: Jean-Marc M. Bas, Paris, France

[73] Assignee: DEC Graphics France S.A., Creteil Cedex, France

[21] Appl. No.: 454,328

[22] Filed: Dec. 21, 1989

[30] Foreign Application Priority Data

Dec. 30, 1988 [FR] France ..... 88 17470

[51] Int. Cl.[5] ..... B41J 2/32; B41J 3/54

[52] U.S. Cl. ..... 346/76 PH; 400/82; 400/120

[58] Field of Search ..... 400/82, 120, 23, 32, 400/654, 656, 662; 346/76 PH

[56] References Cited

U.S. PATENT DOCUMENTS

| | | | |
|---|---|---|---|
| 4,342,040 | 7/1982 | Fujita et al. | 346/76 R |
| 4,530,613 | 7/1985 | Horman et al. . | |
| 4,591,969 | 5/1986 | Bloom et al. . | |
| 4,660,052 | 4/1987 | Kaiya et al. | 346/76 PH |
| 4,750,006 | 6/1988 | Hashimoto . | |
| 4,776,711 | 10/1988 | Harada . | |
| 4,868,676 | 9/1989 | Matsuura et al. | 346/76 PH |
| 4,946,297 | 8/1990 | Koike et al. | 400/82 |

FOREIGN PATENT DOCUMENTS

| | | | |
|---|---|---|---|
| 2620085 | of 0000 | France . | |
| 58-187382 | of 0000 | Japan . | |
| 61-87219 | 4/1986 | Japan | 400/82 |
| 0114863 | 6/1986 | Japan | 346/76 PH |
| 0244659 | 10/1987 | Japan | 400/82 |
| 0026461 | 1/1989 | Japan | 346/76 PH |

*Primary Examiner*—Benjamin R. Fuller
*Assistant Examiner*—Huan Tran

[57] ABSTRACT

A thermal printer for wide printing comprises a plurality of offset thermal print heads bearing against a rounded fixed anvil. The heads are mounted so that the active faces of each pair of successive heads form a dihedral angle in order to make tangential contact with the anvil along the active lines of heads. The printer includes a drum for driving the paper with the drum having a diameter which is greater than a predetermined value. Printing is controlled in response to a signal representative of paper advance as generated by an encoder driven by a wheel in tangential contact with the paper.

19 Claims, 4 Drawing Sheets

WIDE THERMAL PRINTER

REFERENCE TO RELATED APPLICATION

This application claims the benefit of prior filed French Patent Application No. 8817470, filed Dec. 30, 1988.

BACKGROUND OF THE INVENTION

1. Field of the Invention

The invention relates to computer controlled graphics machines, and in particular to wide thermal printers.

2. Description of the Prior Art

Conventional thermal printers used for printing narrow text or drawings include a device for driving thermal paper, and a print head having an active strip of resistances disposed transversely across the paper. The head is pressed against the paper and a rotating platen provides backing pressure. The paper is driven by means of a motorized drum with a pressure wheel pressing the paper against the drum. The platen for providing the print head backing may also be used as the paper-driving drum.

The thermal print head strips which are currently available in the trade are relatively short, being generally less than 32 cm. long. A known technique for obtaining large format drawings is to use a plurality of print heads which are offset relative to one another to cover the entire width of the paper. Thus, to obtain a transverse line of points, a first transverse segment is printed using a first head, the paper is advanced until the first printed segment is aligned with a second head, and a second segment is then printed with the second head. Such a technique is described in U.S. Pat. No. 4,660,052 (Kaiya). In this technique, the motorized drum is driven by a stepper motor to synchronize the instant at which the successive heads write with the motion of the paper drive drum.

One disadvantage of this technique is that it leaves line defects at the junctions between different print heads, which defects are increasingly undesirable, given the quality criteria expected of modern graphics machines. Because of manufacturing tolerances in the mechanical components of the machine, and because of the elasticity of the paper, the paper does not move along an exactly rectilinear trajectory, nor does it reproduce the motion of the driving drum stepper motor exactly. Thus, even if each machine is individually adjusted to eliminate junction defects, on average, it is still not possible with machines of the type described in the above-mentioned Kaiya patent to eliminate fluctuations in such defects by performing such adjustment.

This invention provides a multihead thermal printer in which drawing imperfections at the junctions between heads are considerably reduced. It also provides a wide thermal printer of relatively low cost, which is easy to use, and which provides high-quality marking.

SUMMARY OF THE INVENTION

In a preferred embodiment, the present invention provides a thermal printer which includes a frame; a drive for advancing a print medium; a plurality of write heads each shorter than the width of the print medium, the heads being distributed along the width with successive pairs of heads being offset relative to one another and overlapping partially; and thrust means for pressing the heads against backing means to pinch the print medium between the heads and the backing means.

In particular, the printer includes backing means constituted by a transverse member having a rounded thrust surface over which the print medium is guided, and heads mounted on the frame in such a manner that the active faces of two successive heads form a dihedral angle so as to make tangential contact along their respective active lines with the rounded surface of the transverse member.

The transverse backing member is preferably a fixed anvil comprising a portion made of resilient material and an anti-adhesive coating deposited on the resilient portion. The print medium drive means comprises a drum rotated by a motor and adapted to press the print medium against drum backing means, with the diameter of the drum being greater than a predetermined value. The drum backing means is formed by a fixed platform.

According to another preferred feature, the printer includes a displacement sensor for generating a signal representative of the displacement of the print medium, means for triggering writing by the heads, and means for controlling the triggering of writing by the heads in response to the signal representative of displacement of the print medium.

As mentioned above, using a plurality of offset heads for tracing a line of points across the width of the paper gives rise to imperfections in the lines traced, and more particularly to junction defects. We use the term "junction defect" to mean an offset or gap in the direction of paper displacement and in the transverse direction between two line segments marked by two successive heads being controlled to print a single line of printing. According to the invention, investigations have shown that junction defects in the direction of paper displacement obey a periodic function whose amplitude depends mainly on $\sin(x/D)$, where x is the curvilinear distance along the path followed by the paper between the active lines of two heads, and D is the diameter of the paper drive drum. In conventional wide machines, the distance from one head to another is long since it is greater than the sum of the radii of the head backing rolls. It is also found that each rotating component pressed against the paper gives rise to an error which is specific thereto and whose period depends on the diameter of the component. For example, a displacement sensor in the form of a measuring wheel having a diameter $\phi$ and bearing against the print medium gives rise to an error which is proportional to $\sin(x/\phi)$.

By disposing the heads to bear against a single rounded component, it is possible to move the active lines of the heads closer together (i.e., to reduce x), thereby considerably reducing junction defects. In addition, the drum diameter D and the measuring wheel diameter $\phi$ are also increased, and as small a number of rotating components as possible are used that make contact with the print medium to further reduce junction defects due to imperfections in the rotating components.

To obtain a drawing with small junction defects (0.06 mm. to 0.07 mm.), a machine in accordance with the invention has been built such that the ratio $x_M/D$ is less than 0.55, where $x_M$ is the curvilinear distance between the two furthest-apart print heads. In addition, when using a displacement sensor in the form of a coding wheel, the wheel diameter $\phi$ is selected so that the ratio $x_M/\phi$ is less than 0.75.

The characteristics and advantages of the invention appear more clearly from the following description given by way of example and with reference to the accompanying drawings.

DETAILED DESCRIPTION OF THE PREFERRED EMBODIMENTS

Figure 1:
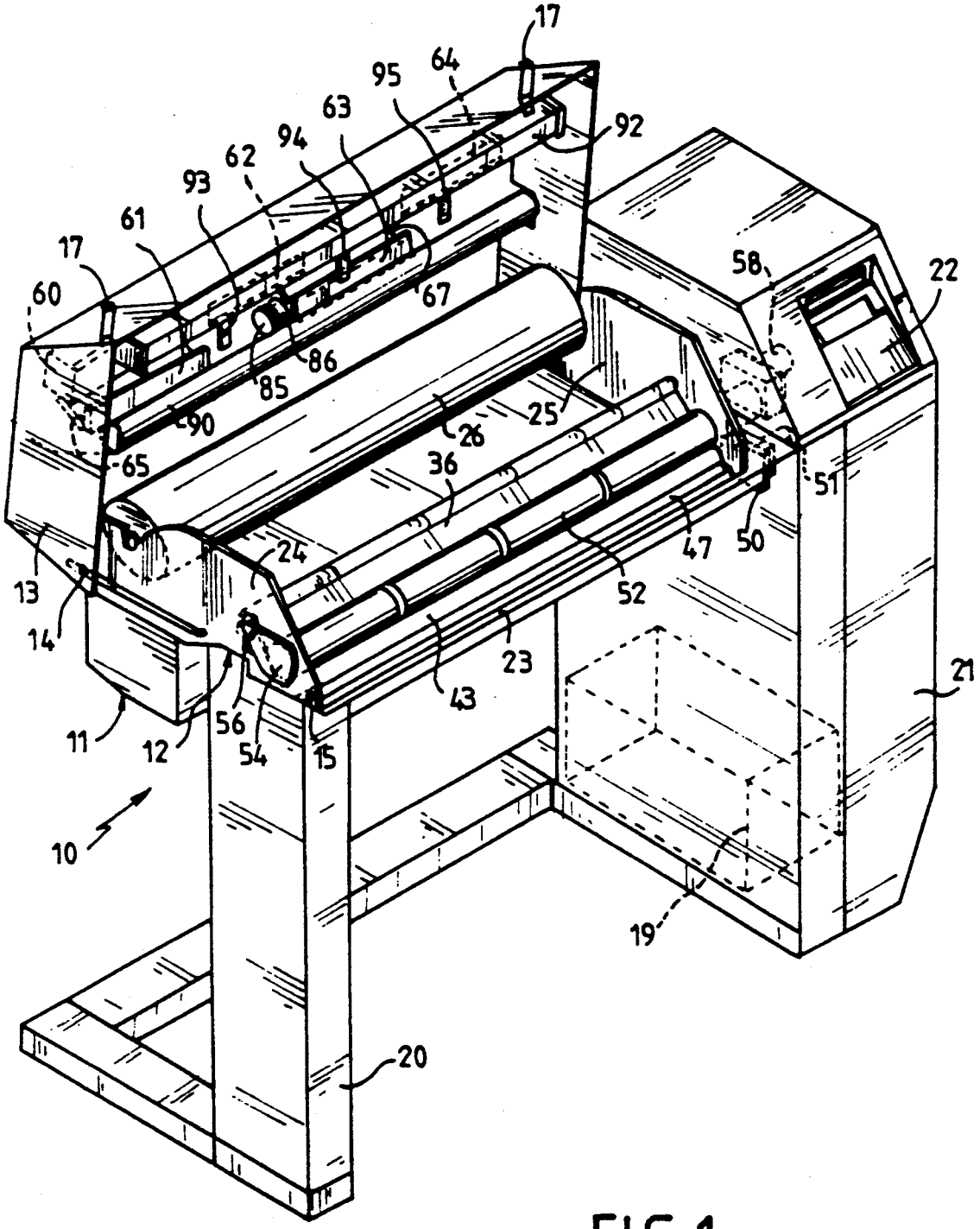
FIG. 1 is a perspective view of a thermal print graphics machine in accordance with the invention and shown with its cover in the open position.
Figure 2:
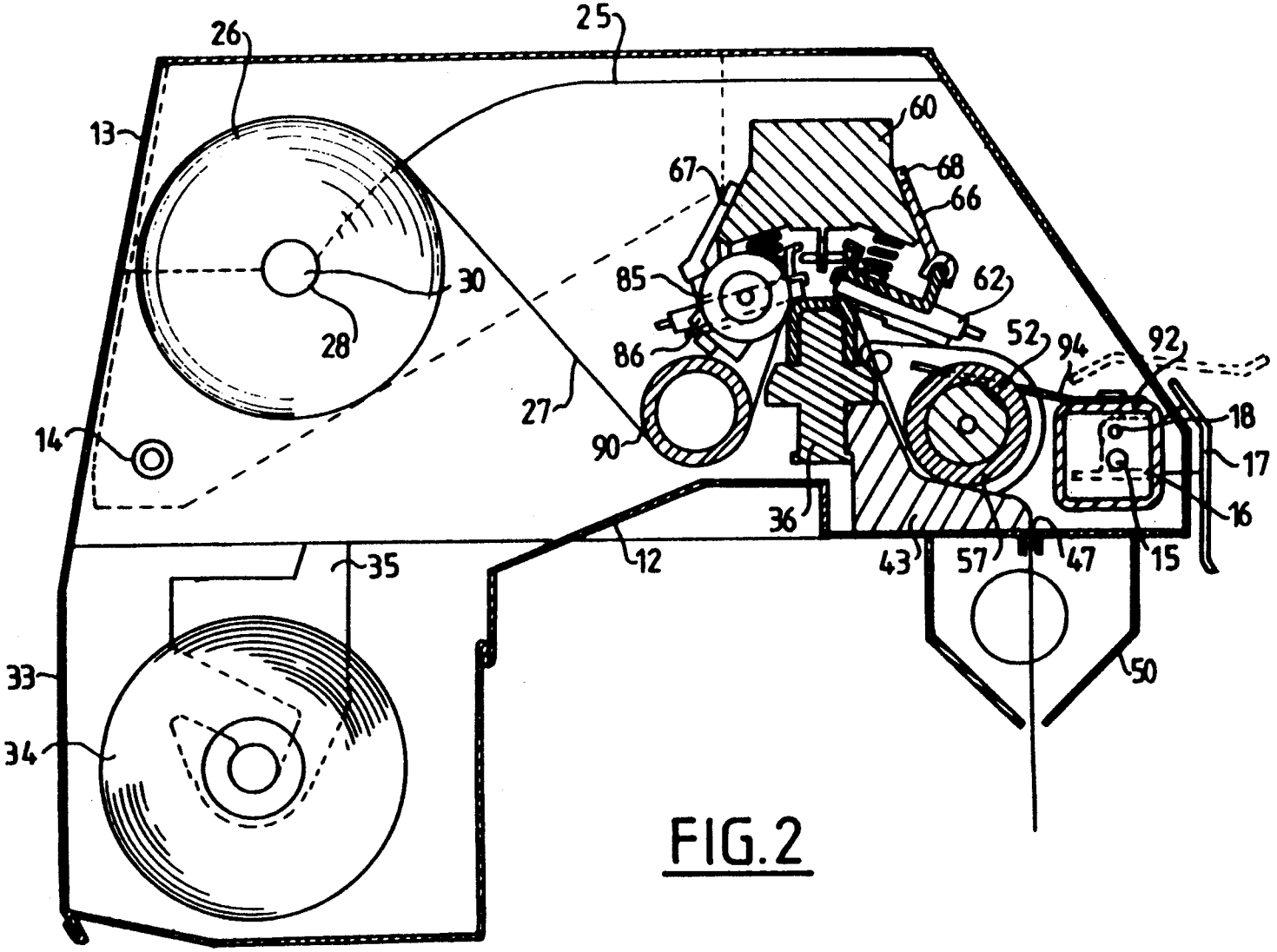
FIG. 2 is a vertical section through the FIG. 1 machine taken in the proximity of the middle of its paper roll.

With reference to FIG. 1, a wide thermal printer or graphics machine 10 comprises a frame 11 constituted by a base 12 and a cover 13 mounted to pivot on the base 12 about a transverse axis 14 so as to be movable between a closed position corresponding to printer operation and an open position as shown in FIG. 1 enabling print media to be inserted in the machine. Each side of the base 12 is fitted with a peg 15 which cooperates with a blade 16 of a locking lever 17 (see FIG. 2) pivotally mounted on the cover about an axis 18 to hold the cover securely in the closed position. The cover 13 is unlocked by manually pulling the levers 17 upwards, thereby releasing the cover 13 to allow it to be lifted rearwards to the position shown in FIG. 1.

The base 12 has a lefthand riser 20 and righthand riser 21 which contains the electronic circuits 19 for controlling the machine, and which has a controlling keypad 22 disposed at the top thereof. The base also includes a transverse top portion 23 delimited to left and right by two vertical plates 24 and 25 which are adapted to receive a roll 26 of print medium 27, i.e., thermal paper.

Each of the vertical plates 24 and 25 has a notch 28 (FIG. 2) near the rear of the machine in which the shaft 30 of the roll 26 is free to rotate while paper is being paid out from the roll. The base 12 also contains a spare roll of paper 34 in a rear compartment 33 with the shaft of the spare roll being supported by lateral supports enabling the spare roll to rotate freely. The machine 10 may be fed with paper equally well from the roll 26 or from the spare roll 34.

An anvil and platform assembly 36, 43 is fixed inside the base 12, and it extends over the entire width of the machine. This assembly (FIG. 3) comprises an anvil 36 in the form of a transverse beam having a metal core with a rounded top surface 37 over which the print medium is guided. This rounded top surface 37 serves as the thrust backing surface for the print heads, as explained below. A layer of resilient material 40, for example, of the neoprene or other resilient material, and having a thickness of several millimeters is fixed on the top portion of the anvil 36. The neoprene is itself protected by an anti-adhesive and anti-static coating 41, for example, of polyethylene-type material. The print medium 27 slides over the anti-adhesive coating 41.

The assembly 36, 43 also includes a platform 43 constituted by another transverse beam having a plane portion 44 covered with an anti-adhesive coating 45. Towards the front of the machine, the plane portion 44 is extended by a curved surface 46 whose bottom end leads to a slot 47 (FIG. 2) made through the base. The print medium 27 follows the plane portion 44 and then the curved surface 46 before passing through the slot 47 and through a cutter 50. Various types of cutters may be used providing they are suitable for cutting the print medium transversely once a drawing has been made. In the example described, this cutter 50 is a rotary knife driven by a motor 51 (shown in dashed lines in FIG. 1). Such a knife serves to cut the print medium quickly after a drawing has been made.

A drum 52 for driving the print medium 27 is mounted in the top portion of the base 12. The drum 52 has a shaft 53 mounted to rotate in two bearings 54 and 55 disposed at the ends of said drum. The shaft 53 is coated with a plurality of rubberized segments 57 with intermediate rings 96 rotatably mounted therebetween.

The bearing 54 and 55 are pivotally mounted to respective ones of the vertical plates 24 and 25 about a common axis 56 to enable the drum 52 to be moved between a first position in which it is close to the platform 43, and a second position which is at a distance from the platform 43. In the first position, the drum presses the print medium 27 against the platform, while in the second position it does not, thereby enabling the print medium to be manually inserted from the roll 26 between the driving drum 52 and the platform. An electric motor 58 (shown in dashed lines in FIG. 1) is mounted on the righthand bearing 55 (the bearing adjacent to the riser 21), and the outlet shaft of the motor is connected to rotate the shaft of the drum 52. As explained below, the drum 52 is pressed against the platform 43 by thrust means disposed in the cover 13, such that the thrust force is applied to the drum only when the cover is in its closed position.

The axis 56 about which the bearings 54 and 55 pivot lies substantially in the plane of the section of paper extending between the anvil 36 and the drive drum 52 so that variations in paper tension do not have any influence on the force with which the drum is pressed against the platform 43.

Figure 3:
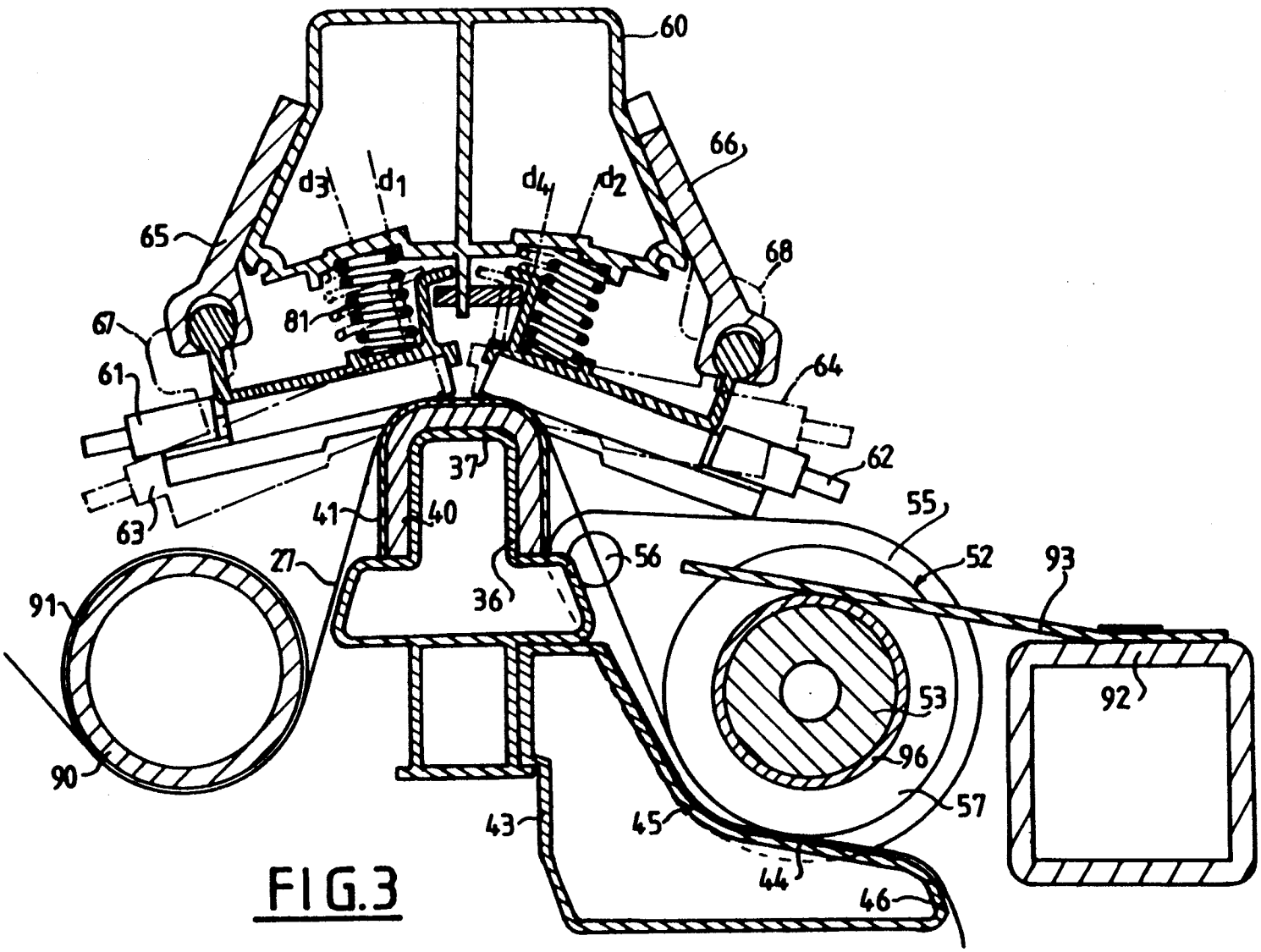
FIG. 3 is a fragmentary vertical section on a larger scale through the FIG. 1 machine and taken in the proximity of its lefthand riser.

A head support 60 is fixed inside the cover 13 in the form of a beam extending over the entire width of the print medium 27, and it carries four thermal print heads 61, 62, 63, and 64 via four respective link pieces 65, 66, 67, and 68. The heads 61 to 64 and their associated link pieces 65 to 68 are mounted alternately at the back and at the front of the support 60 so that their active lines bear tangentially along alternating rear and front portions of the rounded surface 37 of the anvil 36 when the cover is in its closed position. The active faces of two successive heads thus form a dihedral angle overlying the anvil 36. Each of the link pieces 65 to 68 may be fixed to the support 60 either in a high position or in a low position, thereby causing the active face of the associated head to slope to a greater or lesser extent relative to the anvil. The link pieces 65 and 68 are fixed in the high position, while the link pieces 66 and 67 are fixed in the low position, such that the active faces of the heads 65 and 68 are perpendicular to four respective different thrust directions d1, d2, d3, and d3, as shown in FIG. 3. The active lines thus bear against four different generator lines of the rounded surface 37. This offset between the four active lines is selected so as to spread out the average consumption of electric energy by the heads more uniformly. With this disposition, a transverse line of points is printed as four successive segments on four successive occasions in time. This avoids energy consumption peaks corresponding to transverse lines being printed across the entire width of the paper, which occurs relatively frequently.

Figure 4:
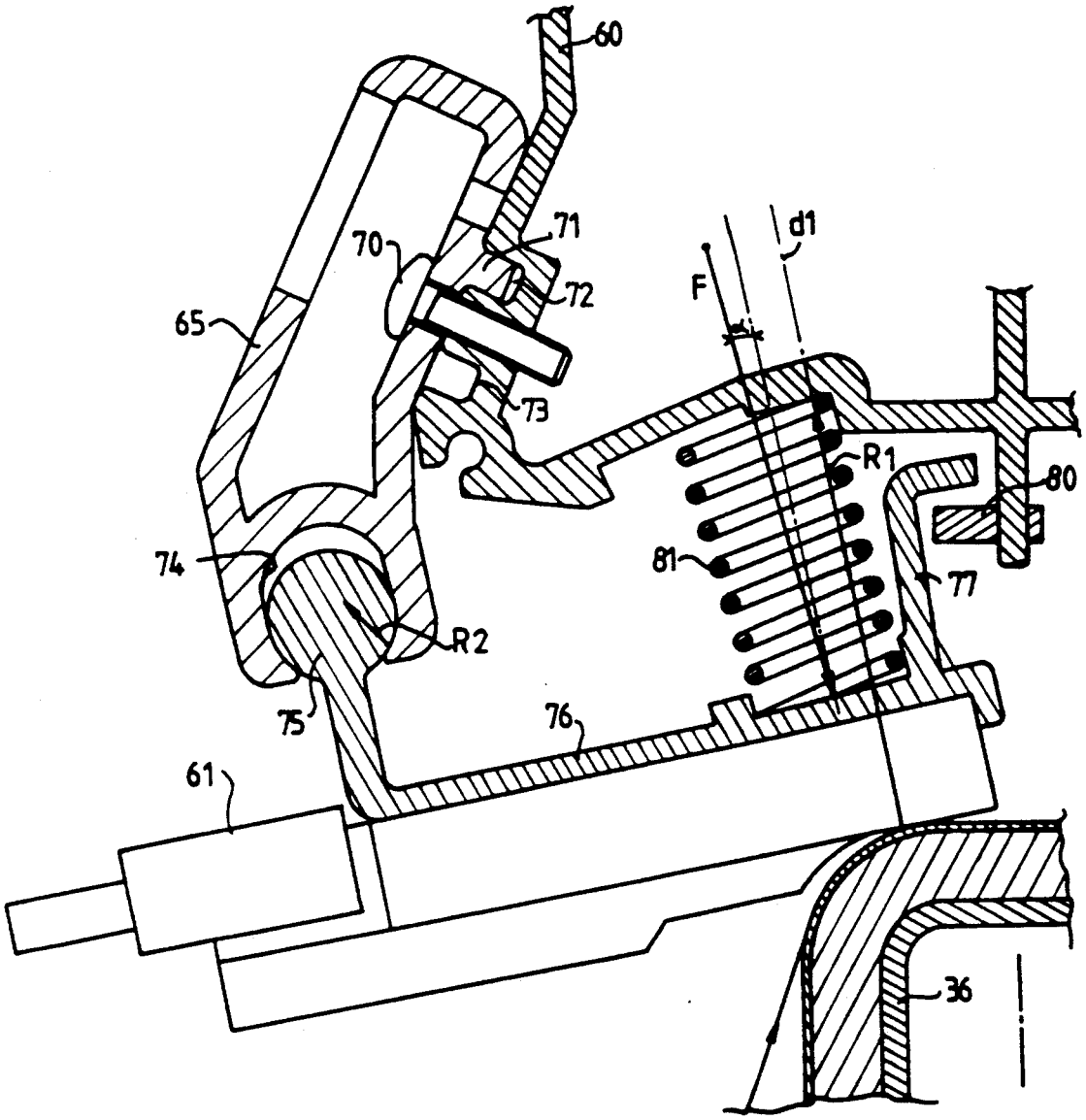
FIG. 4 is a view of a portion of FIG. 3 shown on a still larger scale.

FIG. 4 shows how the first head 61 is mounted, with the other heads being mounted in similar manner. The link piece 65 is fixed to the support 60 by screws 70. Link piece 65 includes, parallel to the transverse direction, a rib 71 suitable for engaging in one or other of two grooves 72 and 73 in the support 60, thus allowing the link piece 65 to be fixed to the support either in the high position, shown in FIG. 4, or else in a low position. The bottom end of the link piece 65 has a groove 74 suitable for receiving one or more hinges 75 projecting from a mounting plate 76 on which the head 61 is mounted. The mounting plate 76 also includes a curved finger 77 whose downwards motion is limited by an abutment 80 fixed to the head support 60. One or more coil springs 81 (e.g., three) are interposed between the support 60 and the mounting plate 76, thereby urging the plate 76 to press the head 60 against the anvil 36 with a force F. The groove 75 is deeper than the diameter of the hinges 75, thereby allowing the head 63 to move a little in a direction which is approximately parallel to the direction of the force F. The head is thus loosely mounted on the support 60, thereby enabling the ends of the active line to move away to a limited extent from the support 60 independently of one another. The active line is thus properly applied to press along a generator line of the rounded surface of the anvil 36.

The coil springs 81 are disposed in such a manner that the force F is applied to the head between the active line and the hinges 75. Also, the coil springs are inclined so that the force F is at an angle $\alpha$ to the direction d1 of the reaction R1 applied to the head by the anvil 36. The purpose of this disposition is to apply a component of force to the head which is directed along the direction of paper advance. FIG. 4 shows the head 61 when the forces applied thereto are in static equilibrium, with the force F of the springs 81 being balanced by the reactions R1 and R2 applied to the head by the anvil 36 and by the link piece 65. The head is thus firmly pressed against the face of the link piece 65 in the direction of paper advance. In a particular embodiment, the dimensions and positions of the springs 81 are selected to obtain a reaction R1 of about 6 daN, and a reaction R2 of about 1 daN.

To sum up, each head is mounted so as to be held accurately in the direction of paper advance. Abutments (not shown) prevent each head from moving transversely relative to the paper, i.e., along the width of the paper. Other mounting means would naturally be possible, providing they hold the head in the two above-mentioned directions while leaving it a small amount of freedom to move in the thrust direction.

A measuring wheel 85 (see FIGS. 1 and 2) is mounted beneath the head support 60 and approximately in the middle thereof for bearing against the anvil 36. Resilient mounting means may be provided to ensure that the wheel 85 bears appropriately against the print medium. The shaft of the measuring wheel 85 is connected to an optical encoder 86 which delivers an output signal representative of wheel rotation, i.e., of the displacement of the print medium. The output signal from the encoder 86 is sent to the electronic circuits 19 placed in the righthand riser 21 of the base.

A tubular guide 90 for the print medium is fixed beneath the head support 60 and just behind it, with the guide extending transversely over the entire width of the paper and being fitted with an anti-adhesive coating 91. The guide 90, the anvil 36, the platform 43, and the drum 52 together define the path followed by the print medium 27 after leaving the roll 26, with the medium sliding over the guide 90 and the anvil 36, and passing between the drum 52 and the platform 44.

A square section beam 92 is disposed inside the cover 13 in front of the heads, with the beam 92 carrying a plurality of thrust members 93, 94, and 95 for applying a downwards force on the drive drum 52 when the cover is closed, thereby pinching the print medium between the drum and the platform 43. Each of the thrust members 93, 94, and 95 is in the form of a spring blade with one end fixed to the beam 92 and with its other end bearing against one of the rings 95 rotatably mounted on the shaft 53 of the drum 52. By opening the cover, the force applied to the drum 52 is removed and the drum is lifted by a spring (not shown) to allow the print medium 27 to be inserted between the drum 52 and the platform 43.

In operation, a roll of thermal paper 26 is initially placed in the machine while its cover is open. A sufficient length of paper is pulled from the roll and passed between the drum 52 and the platform 43 and then through the slot 47. Thereafter, the cover 13 is closed thus pressing the write heads 61 to 64 against the anvil 36 and also pressing the drum 52 against the platform 43. The printer is then ready to execute a drawing.

A drawing is executed under the control of a microprocessor included in the electronic circuitry controlling the printer. A drawing is stored in conventional manner in an initial memory in the form of a succession of transverse lines of points. The control system divides the drawing into four strips corresponding to respective ones of the four portions to be printed by each of the four heads. These four strips are stored, in full or in part, in a buffer memory after being shifted relative to one another by distances corresponding to the offsets x between the heads. The data in the buffer memories, including the inter-head offsets, is applied to the head activation circuits in response to the signal delivered by the encoder 86 to cause writing to be triggered as a function of paper advance.

Since the measuring wheel can be made with a very high degree of accuracy, a preferred embodiment of the printer of this invention is capable of substantially eliminating junction defects in the middle of the sheet, e.g., between heads 62 and 63. In addition, junction defects between the heads 61 and 62 and between the heads 63 and 64 are minimized by virtue of the small curvilinear distance x between their active lines as obtained by the dihedral disposition of the heads against the anvil 36. Finally, the small number of rotary components bearing against the print medium and the large diameters thereof further reduce junction defects due to such components.

The above-described machine is designed to be capable of producing drawings in A0 format using four heads each having a length of 256 mm. and covering a total length of 915 mm.

Another machine has also been designed for A1 format using three thermal heads each having a length of 256 mm. and covering a total of 610 mm. The invention may naturally also be applied to other embodiments having arbitrary numbers of offset heads.

I claim:

1. A thermal printer comprising:

a frame;

print medium drive means for advancing a print medium having a width;

backing means for supporting the print medium, the backing means including a transverse member having a rounded thrust surface over which the print medium is guided;

a plurality of write heads each shorter than the width of the print medium, the heads being distributed along the width with successive pairs of heads being offset relative to one another and overlapping partially and in such a manner that active faces of two successive heads form a dihedral angle so as to make tangential contact along respective active lines with the rounded surface of the transverse member; and thrust means for pressing the heads against backing means to pinch the print medium between the heads and the backing means.

2. A printer as in claim 1, wherein the transverse member comprises a fixed anvil.

3. A printer as in claim 2, wherein the fixed anvil comprises a metal core extending transversely relative to the print medium, a layer of resilient material disposed over the metal core, and an anti-adhesive coating disposed over the resilient material to enable the print medium to slide thereover.

4. A printer as in claim 1, wherein the thrust means comprises a plurality of springs for applying respective forces to each of the write heads, each of the respective forces being inclined relative to a thrust direction of the head so as to provide a component of force in a direction of print medium advance.

5. A printer as in claim 1 further comprising:

a displacement sensor for generating a signal representative of print medium displacement;

means for triggering writing by the heads; and means for controlling the triggering of writing by the heads in response to the signal representative of print medium displacement.

6. A printer as in claim 5, wherein the displacement sensor comprises:

a wheel bearing against the print medium; and a position encoder connected to the wheel to generate the signal representative of print medium displacement.

7. A thermal printer comprising:

a frame;

print medium drive means for advancing a print medium having a width, wherein the print medium drive means includes a rotatable drum adapted to press the print medium against a drum backing means;

a backing means for supporting the print medium, the backing means including a transverse member having a rounded thrust surface over which the print medium is guided;

a plurality of write heads each shorter than the width of the print medium, the heads being distributed along the width with successive pairs of heads being offset relative to one another and overlapping partially and in such a manner that active faces of two successive heads form a dihedral angle so as to make tangential contact along respective active lines with the rounded surface of the transverse member, the drum having a diameter D greater than a predetermined value such that a ratio $X_M/D$ is less than 0.55, where $X_M$ is a maximum curvilinear distance along a path of the print medium between active lines of two successive write heads, the active lines having ends; and thrust means for pressing the heads against backing means to pinch the print medium between the heads and the backing means.

8. A printer as in claim 7, wherein the drum backing means comprises a platform fixed to the frame.

9. A printer as in claim 8, wherein the platform further includes an anti-adhesive coating over which the print medium slides.

10. A printer as in claim 8, wherein the frame comprises a base and a cover hinged to the base, wherein the platform is fixed to the base, wherein the drum is hinged to the base to move between a far position relative to the platform and a position in which it bears against the platform, and including thrust means fixed to the cover to press the drum against the platform when the cover is closed, and to separate the drum from the platform when the cover is open.

11. A printer as in claim 7, wherein the drum is hinged to the frame about an axis to enable it to move between a far position and a close position relative to the backing means, the axis being situated substantially in a plane of the print medium upstream from the drum so that a force with which the drum is pressed against the backing means is independent of variation in tension of the print medium.

12. A printer as in claim 7, wherein the transverse member comprises a fixed anvil.

13. A printer as in claim 12, wherein the fixed anvil comprises a metal core extending transversely relative to the print medium, a layer of resilient material disposed over the metal core, and an anti-adhesive coating disposed over the resilient material to enable the print medium to slide thereover.

14. A printer as in claim 7, wherein the thrust means comprises a plurality of springs for applying respective forces to each of the write heads, each of the respective forces being inclined relative to a thrust direction of the head so as to provide a component of force in a direction of print medium advance.

15. A printer as in claim 14, wherein each of the heads is loosely mounted on the frame so as to be free to move over a limited distance in a thrust direction of the head so that the ends of each active line can be pressed independently against the transverse member by the thrust means.

16. A thermal printer comprising:

a frame;

print medium drive means for advancing a print medium having a width;

backing means for supporting the print medium, the backing means including a transverse member having a rounded thrust surface over which the print medium is guided;

a plurality of write heads each shorter than the width of the print medium, the heads being distributed along the width with successive pairs of heads being offset relative to one another and overlapping partially and in such a manner that active faces of two successive heads form a dihedral angle so as to make tangential contact along respective active lines with the rounded surface of the transverse member, the active lines having ends;

thrust means for pressing the heads against backing means to pinch the print medium between the heads and the backing means, wherein the thrust means comprises a plurality of springs for applying respective forces to each of the write heads, each of the respective forces being inclined relative to a thrust direction of the head so as to provide a component of force in a direction of print medium advance, wherein each of the heads is loosely mounted on the frame so as to be free to move over a limited distance in the thrust direction of the head so that the ends of each active line can be pressed independently against the transverse member by the thrust means.

17. A thermal printer comprising:

a frame;

print medium drive means for advancing a print medium having a width;

backing means for supporting the print medium, the backing means including a transverse member having a rounded thrust surface over which the print medium is guided;

a plurality of write heads each shorter than the width of the print medium, the heads being distributed along the width with successive pairs of heads being offset relative to one another and overlapping partially and in such a manner that active faces of two successive heads form a dihedral angle so as to make tangential contact along respective active lines with the rounded surface of the transverse member;

thrust means for pressing the heads against backing means to pinch the print medium between the heads and the backing means;

a displacement sensor for generating a signal representative of print medium displacement, wherein the displacement sensor is further comprised of a wheel bearing against the print medium, and a position encoder connected to the wheel to generate the signal representative of print medium displacement, wherein the wheel has a diameter $\phi$ greater than a predetermined value such that a ratio $X_M/\phi$ is less than 0.75, where $X_M$ is a maximum curvilinear distance along a path of the print medium between the active lines of two successive heads;

means for triggering writing by the heads; and means for controlling the triggering of writing by the heads in response to the signal representative of print medium displacement.

18. A thermal printer comprising:

a frame;

print medium drive means for advancing a print medium having a width;

backing means for supporting the print medium, the backing means including a transverse member having a rounded thrust surface over which the print medium is guided;

a plurality of write heads each shorter than the width of the print medium, the heads being distributed along the width with successive pairs of heads being offset relative to one another and overlapping partially and in such a manner that active faces of two successive heads form a dihedral angle so as to make tangential contact along respective active lines with the rounded surface of the transverse member; and thrust means for pressing the heads against backing means to pinch the print medium between the heads and the backing means;

a displacement sensor for generating signal representative of print medium displacement, wherein the displacement sensor is further comprised of a wheel bearing against the print medium, and a position encoder connected to the wheel to generate the signal representative of print medium displacement, wherein the wheel has a diameter $\phi$ greater than a predetermined value such that a ratio $x_M/\phi$ is less than 0.75, where $x_M$ is a maximum curvilinear distance along a path of the print medium between the active lines of two successive heads, wherein the wheel is positioned to bear against the print medium substantially in the middle of the width of the print medium;

means for triggering writing by the heads; and means for controlling the triggering of writing by the heads in response to the signal representative of print medium displacement.

19. A thermal printer comprising:

a frame;

print medium drive means for advancing a print medium having a width, the print medium drive means including a rotatable drum adapted to press the print medium against a platform affixed to the frame;

a fixed anvil for supporting the print medium and having a rounded thrust surface over which the print medium is guided;

a plurality of write heads each shorter than the width of the print medium, the heads being distributed along the width with successive pairs of heads being offset relative to one another and overlapping partially and in such a manner that active faces of two successive heads form a dihedral angle so as to make tangential contact along respective active lines with the rounded surface of the fixed anvil;

thrust means for pressing the heads against the anvil to pinch the print medium between the heads and the anvil; and a displacement sensor for generating a signal representative of print medium displacement.

* * * * *

UNITED STATES PATENT AND TRADEMARK OFFICE

CERTIFICATE OF CORRECTION

PATENT NO. : 5,153,606

DATED : October 6, 1992

INVENTOR(S) : Jean-Marc M. Bas

It is certified that error appears in the above—identified patent and that said Letters Patent is hereby corrected as shown below:

Referring to the title page at [73] Assignee, please delete "DEC Graphics France S.A." and insert --OCÉ Graphics France S.A.--

In Col. 10, line 13, please insert "a" after "generating."

Signed and Sealed this

Second Day of November, 1993

*Attest:*

*Attesting Officer*

Bruce Lehman

BRUCE LEHMAN

*Commissioner of Patents and Trademarks*